US007043945B2

(12) United States Patent
Hollingsworth

(10) Patent No.: US 7,043,945 B2
(45) Date of Patent: May 16, 2006

(54) HANDCUFF KEY HAVING EXTENDED GRIP

(76) Inventor: William L. Hollingsworth, P.O. Box 210030, Anchorage, AK (US) 99521

( * ) Notice: Subject to any disclaimer, the term of this patent is extended or adjusted under 35 U.S.C. 154(b) by 0 days.

(21) Appl. No.: 11/121,104

(22) Filed: May 4, 2005

(65) Prior Publication Data

US 2005/0262900 A1 Dec. 1, 2005

Related U.S. Application Data

(60) Provisional application No. 60/574,591, filed on May 27, 2004.

(51) Int. Cl.
*E05B 75/00* (2006.01)
*E05B 19/04* (2006.01)

(52) U.S. Cl. ..... 70/16; 70/402; 70/404; 70/408; D8/347

(58) Field of Classification Search ..... 70/16, 70/402, 403, 404, 408; D8/347
See application file for complete search history.

(56) References Cited

U.S. PATENT DOCUMENTS

| | | | | | |
|---|---|---|---|---|---|
| D155,297 | S | | 9/1949 | Kushner | |
| D186,856 | S | | 12/1959 | Sedley | |
| D228,733 | S | * | 10/1973 | Perkins | D8/347 |
| D244,667 | S | * | 6/1977 | Craft | D8/347 |
| D289,731 | S | * | 5/1987 | Mennie | D8/347 |
| D301,542 | S | | 6/1989 | Kruger | D8/347 |
| D365,270 | S | | 12/1995 | Parsons | D8/347 |
| 5,568,741 | A | * | 10/1996 | Parsons | 70/456 R |
| 5,638,713 | A | | 6/1997 | Roth et al. | 70/404 |
| D390,090 | S | * | 2/1998 | Tobin, Jr. | D8/347 |
| D393,407 | S | | 4/1998 | Parsons | D8/347 |
| D408,712 | S | | 4/1999 | Parsons | D8/347 |
| 6,109,073 | A | | 8/2000 | Parsons | 70/16 |
| D454,774 | S | * | 3/2002 | Stahl | D8/347 |

* cited by examiner

*Primary Examiner*—Suzanne Dino Barrett
(74) *Attorney, Agent, or Firm*—Richard C. Litman

(57) ABSTRACT

A handcuff key "universal" shank and paddle for a common handcuff is attached, in-line, with an enlarged shank extension and bow or grip of a size and shape allowing its use while wearing heavy gloves. The shank extension is sufficiently long to accommodate heavily gloved fingers between the bow or grip and the universal shank and paddle. The enlarged bow or grip of the key is generally circular to fit the palm of a heavily gloved hand, and having a variety of apertures for key rings. The enlarged shank extension defines concave finger-holds for the gloved index and middle finger. The extended shank extends outward from the hand, while the heel of the glove hand engages the rounded rear surface of the bow or grip. The double-lock engaging stem is radially mounted about 60 degrees from the centerline. The key with extended shank is reversed for double-locking.

18 Claims, 4 Drawing Sheets

HANDCUFF KEY HAVING EXTENDED GRIP

CROSS-REFERENCE TO RELATED APPLICATION

This application claims the benefit of U.S. Provisional Patent Application Ser. No. 60/574,591, filed May 27, 2004.

BACKGROUND OF THE INVENTION

1. Field of the Invention

The present invention relates to locks and keys. More particularly, the present invention relates to handcuff keys.

2. Description of the Related Art

Handcuff keys have a shank and paddle of substantially standard or "universal" design and dimensions. Typically, handcuffs have a ratchet and pawl locking system, which is disengaged upon insertion of a key through the keyhole of standard design. The key has a shank and paddle which fit through the keyhole and disengage the teeth of the ratchet with the teeth of the pawl upon turning of the key. The shank and paddle are of standard configuration and size and do not engage tumblers as associated with common locks.

Most modern handcuffs are provided with a double lock feature, wherein a bolt in the handcuffs lock mechanism can be selectively positioned to prevent the pawl from disengaging the ratchet. This feature is activated by depressing a pusher or sliding bar within the handcuff with the double-lock engaging stem of the key. This stem extends axially relative to the shank and outward from the grip or bow of the key in the opposite direction from the shank. The pusher or bar urges the bolt into a double-locked position. The bolt is disengaged by inserting the key into the handcuff keyhole and rotating the key in a first direction. The key may then be counter-rotated to unlock the handcuff.

Known handcuff keys are relatively small overall, requiring the use of a bare hand or hand wearing thin gloves to grasp or manipulate the key during the unlocking process. Also, most persons, such as prison guards or police, carry a large number of keys on the same ring with the handcuff key. It would be desirable to provide a handcuff key which may be gripped and manipulated to lock and unlock handcuffs by a person wearing heavy gloves in cold weather environments. It would also be desirable to provide a handcuff key which stands out from other keys on the ring so that it can be easily identified and grasped without requiring the user to visually identify the key.

U.S. Pat. No. Des. 301,542, issued Jun. 13, 1989, to Kruger depicts a key for handcuffs having an enlarged grip or bow and an enlarged hole arranged in the center thereof that may be used to secure the key to a key chain.

U.S. Pat. No. 365,270, issued Dec. 19, 1995, to Parsons depicts a handcuff key having an enlarged grip or bow and an aperture formed by a bar at the end of the grip.

U.S. Pat. No. Des. 393,407, issued Apr. 14, 1988, to Parsons, depicts another handcuff key design having an enlarged grip displaying an insignia on the side.

U.S. Pat. No. Des. 408,712, issued Apr. 27, 1999, to Parsons, depicts an ornamental extended handcuff key having a state seal displayed on the side and bar clip.

U.S. Pat. No. Des. 155,297, issued Sep. 20, 1949, to Kushner, depicts a key having several irregularly shaped apertures formed in the grip or bow.

U.S. Pat. No. 11,794, issued Jun. 1, 1880, to Barkentin, depicts a key having an arcuate aperture extending along the sides of the grip.

U.S. Pat. No. Des. 186,856, issued Dec. 15, 1959, to Sedley, depicts a key having beads formed on the surface of the grip or bow.

U.S. Pat. No. 5,638,713, issued Jun. 17, 1997, to Roth et al., describes a universal backup handcuff key formed from a single piece of molded plastic having several irregularly shaped apertures formed between the key and the molded support ring structure so that the key may be bent relative to the support ring.

U.S. Pat. No. 6,109,073, issued Aug. 29, 2000, to Parsons, describes a self-aligning handcuff key having an asymmetrical, enlarged portion of the grip or bow on one side such that the key may be easily aligned properly with the keyhole without visual inspection.

None of the above inventions and patents, taken either singly or in combination, is seen to describe the instant invention as claimed. Thus, a handcuff key solving the aforementioned problems is desired.

SUMMARY OF THE INVENTION

The handcuff key of the present invention has a standard or "universal" shank and paddle for insertion into and manipulating the locking mechanism of a common handcuff. The shank is attached, in-line, along a central axis with an enlarged shank extension and bow or grip of a size and shape allowing the manipulation of the shank and paddle while wearing heavy gloves. The shank extension and bow or grip is preferably of a single piece of flat stock. The enlarged shank extension is fashioned from stainless steel flat material, and is sufficiently long to accommodate heavily gloved fingers between the bow or grip and the universal shank and paddle. The flat shank extension is preferably parallel with the plane of the paddle to simplify alignment of the key for insertion into the handcuff. The enlarged bow or grip of the key is generally circular in shape, being of such size as to fit the palm of a heavily gloved hand, and having a variety of shapes and sizes of apertures for mounting on a variety of sizes and designs of key rings. The shank extension and bow or grip is preferably symmetrical relative to the centerline of the universal shank.

The enlarged shank extension meets the bow or grip at a transition point defined by laterally extending, symmetric points which define the rear end of concave, arcuate front finger-holds such that the gloved index and middle finger of the key-manipulating hand of the user may be wrapped around the finger-holds, the extended shank extending outward from the hand, while the heel of the glove hand engages the rounded rear surface of the bow or grip, allowing a secure and accurate grip for ease in the insertion and turning of the key.

The double-lock engaging stem of the inventive key is radially mounted to the outer edge of the generally circular key bow or grip, however, the engaging stem location is rotated away from the centerline of the shank and shank extension to allow gripping pressure to be applied to the rear of the bow or grip relative to the finger-holds. When employing the stem to double-lock the handcuffs, the grip is reversed, with the gloved hand wrapping around the shank extension. The flat extension rests against the palm of the gloved hand, allowing the gloved hand to accurately and securely grip the extension while the thumb and forefinger grip the bow or grip portion. The stem may then be easily aligned with and manipulated for insertion into the receiving bore of the handcuff, the insertion and double-locking being accomplished by the rotation of the gloved hand by the wrist of the user, thereby providing sufficient force to accomplish the double-locking process.

The outsize shape of the inventive handcuff key, shank extension, and bow or grip allow for its immediate recognition by feel, relative to other keys on the key ring, allowing the user to select and grip the handcuff key for use without the need of visual observation. This is important in law-enforcement situations where the handcuffed subject is physically struggling or is otherwise uncooperative.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The handcuff key of the present invention has a standard or "universal" shank and paddle for insertion into and manipulating the locking mechanism of a common handcuff. The shank is attached, in-line, with an enlarged shank extension and bow or grip of a size and shape allowing the use of the key while wearing heavy gloves. The outsized shank extension and bow or grip allows for immediate identification of the handcuff key on a key ring from other keys, allowing its use without requiring the user to look at the key for its identification.

Figure 1:
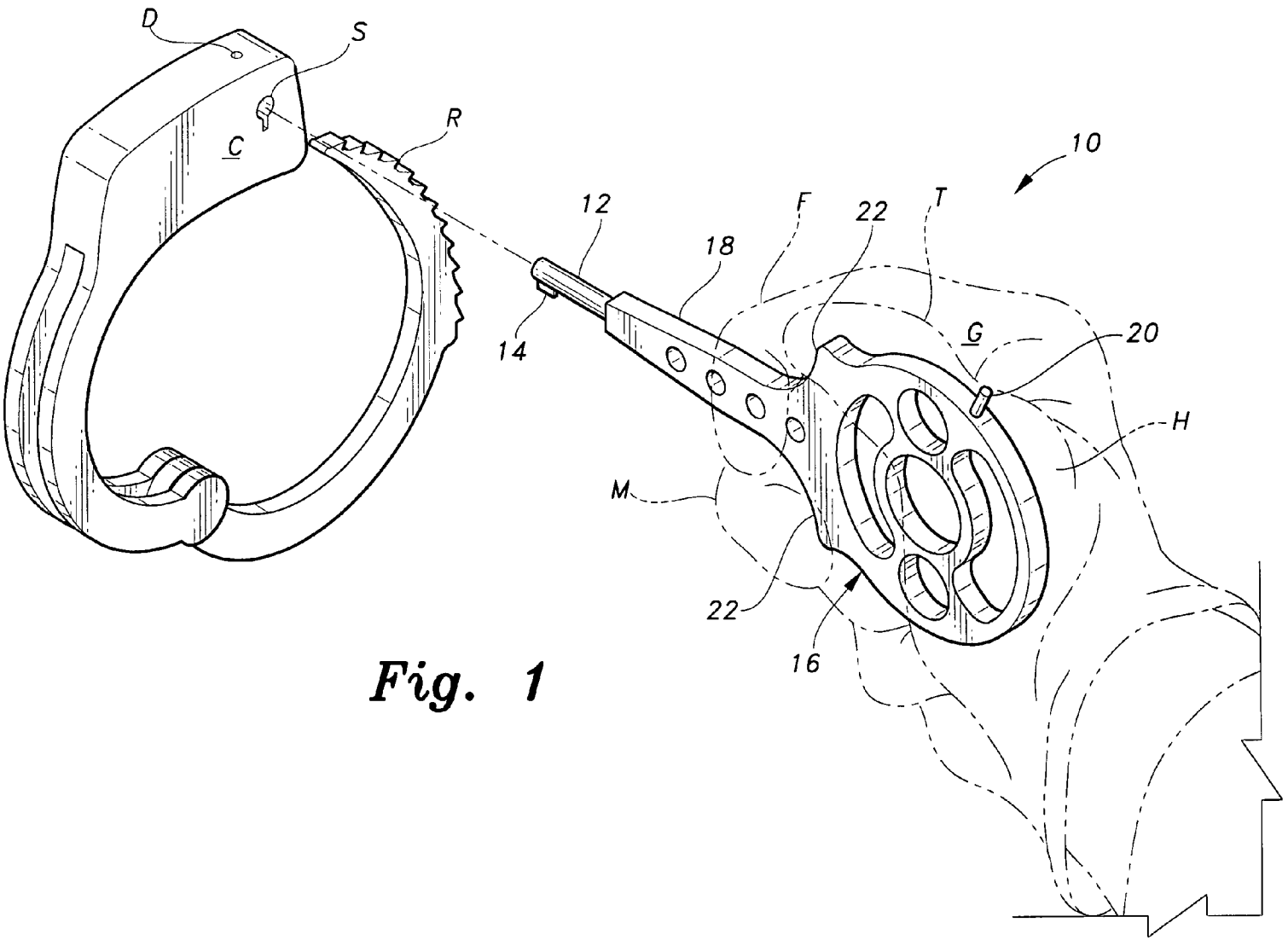
FIG. 1 is an environmental, perspective view of a handcuff key having extended grip according to the present invention.

Referring to the Figures, the inventive handcuff key system of the present invention is referred to by the reference number 10. As seen in FIG. 1, handcuff key system 10 has a key insertion shank 12 and paddle 14 for insertion into key slot S of handcuff C for operation of a pawl (not shown) relative to a ratchet R to unlock the handcuffs as desired. Outsized grip or bow 16 is generally circular in configuration and is attached to the bow end of key insertion shank 12 by a shank extension 18. Grip or bow 16 and shank extension 18 are preferably made from a single flat of metal, such as stainless steel of about 3/16" thickness and is symmetrical relative to the central axis extending through shank 12. A double-lock stem 20 extends radially from the bow or grip 16 rotated at an acute angle relative to the central axis as measured from the rear of the bow. Double-lock stem 20 is of universal design for fitting through double-lock stem receiver D in handcuff C and activating the double-lock mechanism (not shown). Concave arcuate front finger holds 22 extend from the rear portion of the shank extension 18 and define the transition point of the shank extension 18 and grip or bow 16 at points 31 (see FIG. 5).

Figure 3:
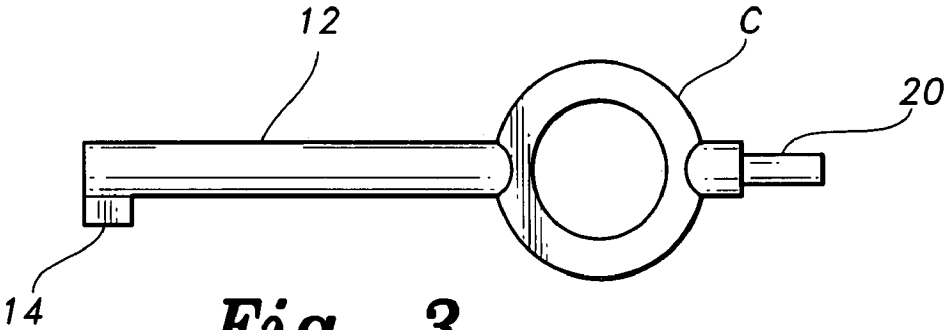
Fig. 3 PRIOR ART
FIG. 3 is an elevation view of a prior art handcuff key.
Figure 4:
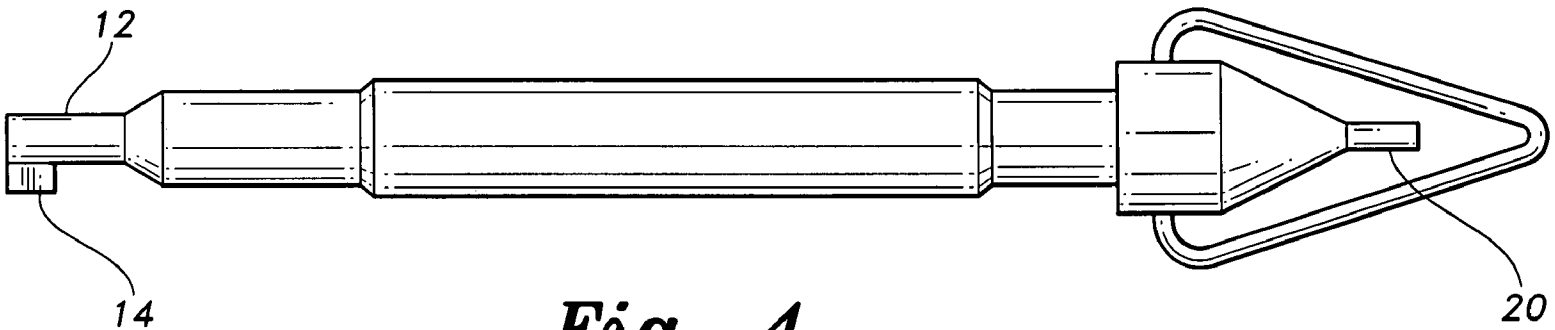
Fig. 4 PRIOR ART
FIG. 4 is an elevation view of another prior art handcuff key.

As shown in FIG. 1, a heavily gloved hand G of the user may firmly grip the bow or grip 16 by encircling the shank extension 18 with his first finger F and middle finger M engaging finger holds 22 and pulling the finger holds 22 and the grip or bow 16 against the heel H of gloved hand G. With this grip, the key insertion shank 12 may be easily aligned and inserted into the key slot S of handcuff C and turned to operate the lock in handcuff C. As may readily be recognized from and inspection of prior art handcuff keys as shown in FIGS. 3 and 4, and as described in the patents cited above, the grip or bow of prior keys cannot be engaged and the shank thereof manipulated while wearing heavy gloves. This problem is exaggerated when the user's hand is unusually large. The removal of gloves for the purpose of using prior handcuff keys risks frostbite in bitterly cold weather.

Figure 2:
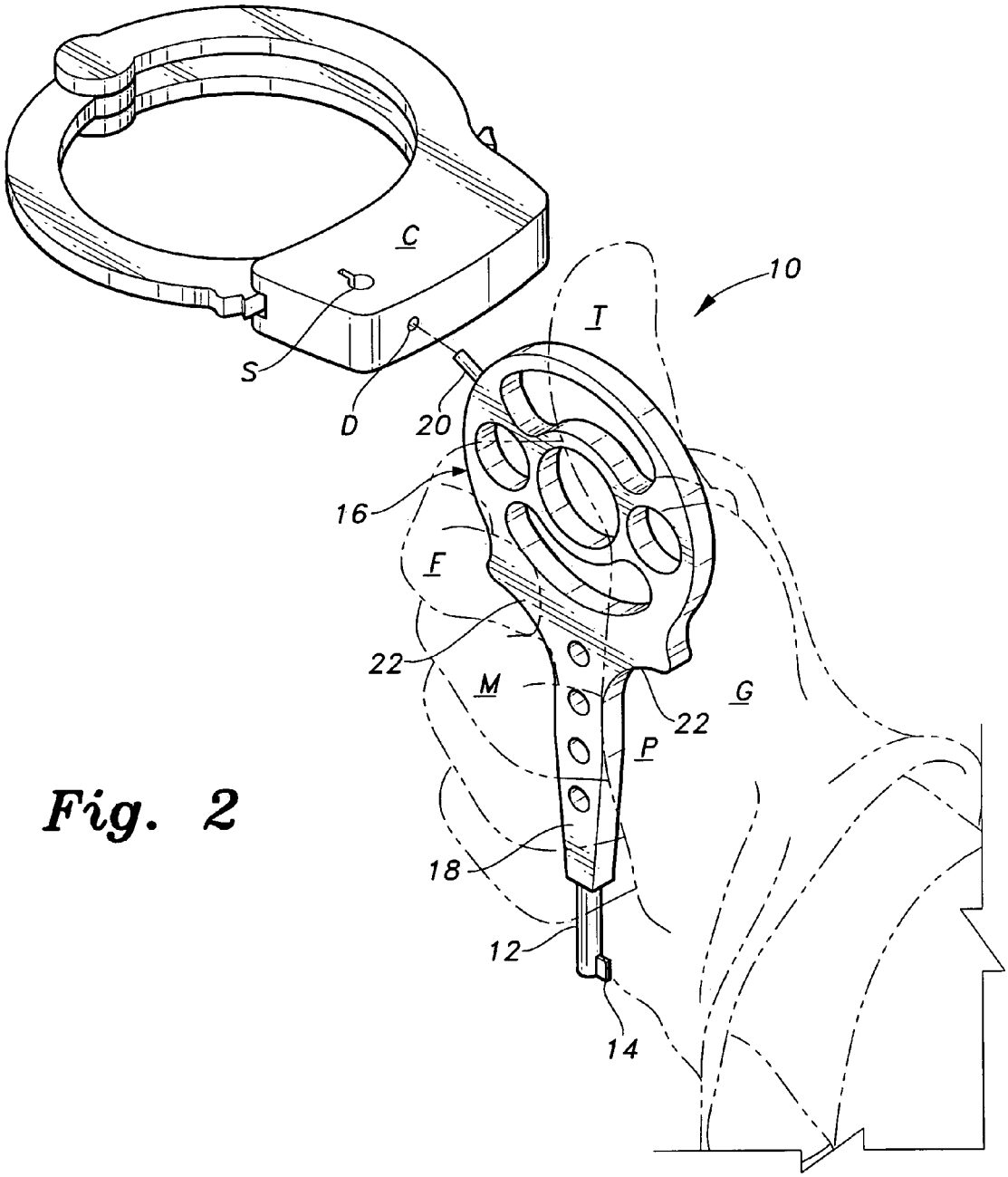
FIG. 2 is another environmental perspective view of the handcuff key of FIG. 1.

Referring to FIG. 2, the handcuff key system 10 of the present invention is shown in another grip by gloved hand G for use in double-locking handcuff C. As illustrated, the shank extension 18 is of sufficient length so as to allow the heavy gloved middle, third, and fourth fingers to wrap around in a natural grip and press against the palm of the gloved hand G, with the first or index finger wrapping around a first one of opposed second finger grips 31, pressing the forward portion of grip or bow 16 into and against the crotch between thumb T and first finger F at the second of opposed forefinger grips 31 (see FIG. 3), the first finger F and thumb T bearing against the opposite side of the grip or bow 16, thereby providing a secure guiding grip of the key system 10. The second finger grips 31 are concave, arcuate in shape and extend from points 23 rearward relative to the key to the grip or bow at crown edge 24. As is shown, this gripping arrangement allows a heavily gloved person to easily align double-lock stem 20 with double-lock stem receiver D for insertion therein by moving gloved hand G to the insertion point, aligning the stem, and inserting the stem, thereby double-locking the internal mechanism by rotation of the person's wrist. Again, frostbite is avoided when using the inventive key system is bitterly cold weather.

Figure 5:
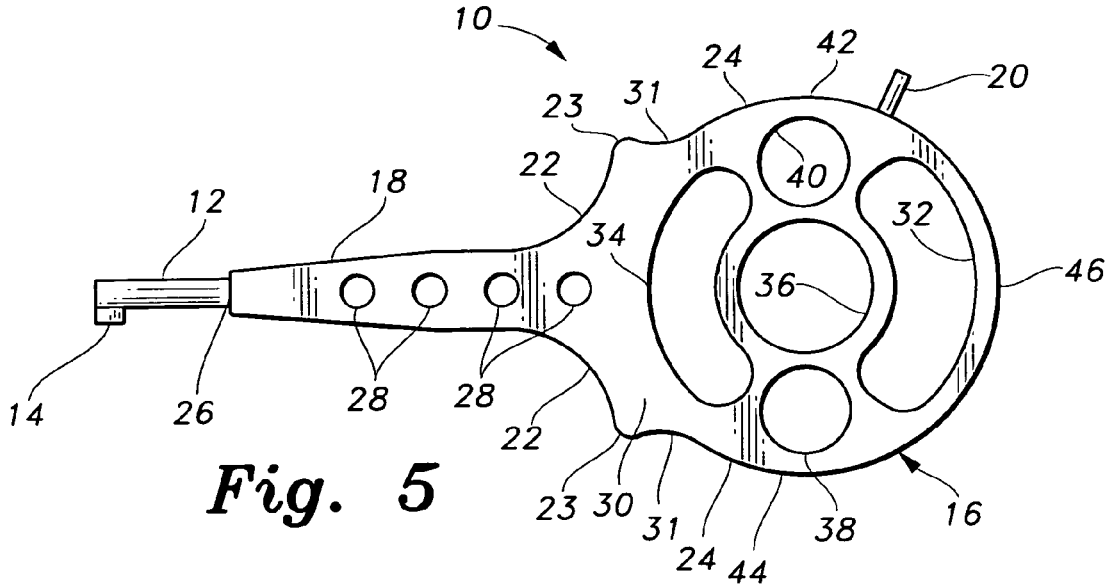
FIG. 5 is a side elevation view of the handcuff key of FIG. 1.
Figure 6:
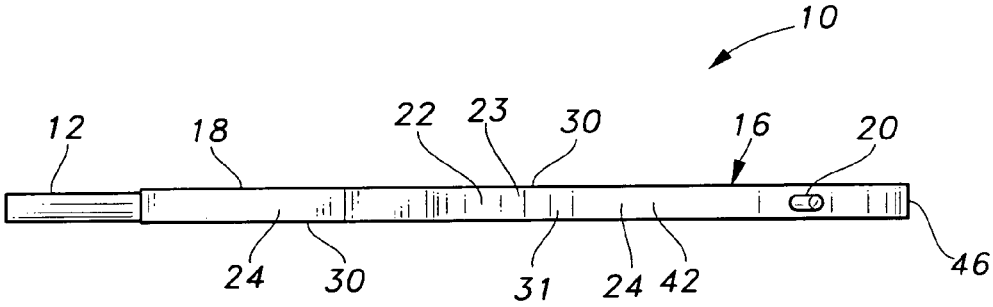
FIG. 6 is a plan view of the handcuff key of FIG. 1.
Figure 7:
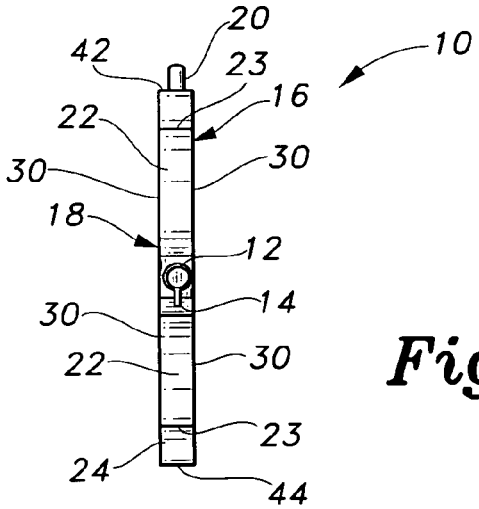
FIG. 7 is a frontal elevation view of the handcuff key of FIG. 1.

Referring to FIGS. 5, 6, and 7, key system 10 is shown in more detail, wherein handcuff key system 10 includes a universal key insertion shank 12 having paddle 14 proximate its forward end, shank 12 having shank extension 18 extending rearward from shank 12 at shank extension connection 26. Shank 18 and grip or bow 16 are formed of a single piece of metal flat such as stainless steel having opposed flat surfaces 30 and a peripheral edge 24. Shank 12 extends to form opposed first concave arcuate finger holds 22 defining the transition of shank extension 18 into outsize grip or bow 16 and ending at points 23. The forward portion of grip or bow 16 extending from points 23 forms concave second finger grips 31 directly to the rear of corresponding first finger grips 22.

Grip or bow 16 is generally circular in shape, shank extension 18 and grip or bow 16 being symmetrical relative to the central axis extending through and from shank 12. Shank extension 18 preferably defines lightening bores 28 spaced therealong for reducing the weight of key system 10.

Grip or bow 16 defines rear curved slot 32 and front curved slot 34 to act as receivers for differing sized key rings or shanks, allowing relative motion of key 10 for manipulation of the insertion shank 12 relative to a handcuff C (see FIG. 1) without removing the key from a ring mounted on a belt or the like. A central bore 36 is provided in grip or bow 16 for fitting on a large key ring or the like. Lower bore 38 and upper bore 40 are of the same diameter, smaller than that of central bore 36 for fastening to a smaller key ring. The symmetry of the key system 10 allows for equal mounting and manipulation of the key without the need for directly observing the key at the time.

The multiple apertures also allow the inventive key to be hung on a support such as a hook while remaining attached to a key ring with other keys mounted thereon. The grip or bow 16 defines an upper edge portion 42, a lower edge portion 44, and a rear edge portion 46, the rear edge portion 46 bearing against the heel of the gloved hand G of the user as illustrated in FIG. 1. The double-lock stem 20 extends radially from the edge 24 of grip or bow 16 and is located between the rear edge portion 46 and one of the upper edge portion 42 and the lower edge portion 44 to allow rear edge portion 42 to bear against the heel of the gloved hand to obtain a solid grip as seen in FIG. 1. This location also allows its easy alignment and manipulation into double-lock stem receiver D as illustrated in FIG. 2.

The overall length of the handcuff key system 10 of the present invention as measured along its central axis is preferably about 5", the universal shank being about ¾" in length and the combined length of the inventive shank extender and grip or bow portion being about 4¼" in length. The combined shank extender 18 and grip or bow 16 is a 3/16" flat attached to the universal shank in the same plane as the paddle of the key as attached to the universal shank. The shank extender 18 is about 1⅛" in length and tapers outward at about a five degree angle relative to the centerline from its front end connection with the universal shank 12 to a point about 1¼ inches rearward from the front end, the shank thereby tapering from a width of 0.218 inches at the front to a maximum of 7/16 inches. A ⅝ inch radius bend extends from a point about 1¾ inches along the shank extension on both the upper and lower sides of the shank extension and end at the transition point to the grip or bow at a shank extension length of 2⅛ inches, forming first finger grips 22 having an overall combined width of about 1 11/16" at the transition point.

The grip or bow 16 is generally circular in shape, having an overall diameter of about 2⅛ inches, and forms a ¾" radius bend at each side as it approaches the transition point and forming forefinger finger holds 31 to the rear of finger holds 22. The double-lock stem 20 is 0.082 inches in diameter and ¼ inch in length extending radially outward from the edge of the bow or edge at an angle of about 60 degrees from the centerline. The grip or bow centerbore 36 is about ¾" in diameter and centered relative to the grip or bow. Lower and upper center bores 38 and 40 are about ½" in diameter, the centers of which, along with the width of the centerbore 36, are in line with a line drawn perpendicular to the centerline of the handcuff key system 10. A rear curved slot 32 extends generally concentric with and spaced inward from the bow rear edge by about 3/32", its maximum width being about 0.450 inches at the key centerline. A similar front curved slot 34 is approximately a mirror image of rear curved slot 32 about the above-mentioned perpendicular line through the centers of the centerbores and having a maximum width of about ⅜". Lightening bores 28 of 7/16" diameter are spaced at intervals of 0.400 inches along the centerline of shank extension 18 for weight reduction.

It is to be understood that the present invention is not limited to the embodiment described above, but encompasses any and all embodiments within the scope of the following claims.

I claim:

1. A handcuff key having a grip useful with gloved hands, comprising:

a universal shank having front and rear ends and defining a centerline;

a lock engaging paddle proximate said front end and depending therefrom;

a shank extension and generally circular grip or bow having flat opposed surfaces;

said shank extension being attached to said universal shank rear end and extending rearward therefrom along said centerline;

said grip or bow extending rearward and outward from said shank extension and having a rear edge portion defined at said centerline;

first opposed finger holds extending outward from said shank to opposed points defining the forward portion of said grip or bow; and a double-lock stem extending radially from said rear edge portion at a point defined by an angle of about 60 degrees from said centerline at said rear portion of said grip or bow;

wherein a user with a heavily gloved hand may maintain a firm grip on said grip or bow by engaging said first opposed finger holds with adjacent gloved fingers and pressing said rear portion of said grip or bow against the gloved heel of the hand of the user;

whereby the user may easily acquire and maintain a grip on said grip or bow and align and engage the key slot and operate the locking mechanism of a handcuff while wearing a heavy glove, thereby avoiding frostbite resulting from removing the glove in frigid temperatures to operate said universal shank and paddle of said handcuff key.

2. The handcuff key of claim 1, said grip or bow defining second opposed finger grips extending rearward of said opposed points, wherein a user wearing a heavy glove is able to grip said shank extension by a heavily gloved middle, third, and fourth finger, whereby the user, upon reversal of said handcuff key in the gloved hand may easily gain and maintain a grip on said shank extension with heavily gloved middle, third, and fourth fingers, and obtain and maintain an enhanced grip by engaging one of said second finger grips with a heavily gloved first finger, and forcing the other of said second grips in the gloved crotch between the first finger and the thumb of the user, thus allowing the user to guide said rear portion of said grip or bow by gripping said grip or bow between said first finger and the user's gloved thumb, thereby allowing the manipulation of said double-lock stem for insertion into a double-lock stem receiver of a handcuff to double-lock same.

3. The handcuff key of claim 2, said grip or bow having an upper edge portion and a lower edge portion, said upper edge portion and said lower edge portion extending rearward from corresponding said second opposed finger grips.

4. The handcuff key of claim 3, said grip or bow defining a center bore for attachment to a large key ring.

5. The handcuff key of claim 4, said grip or bow defining an upper bore and a lower bore, each of lesser diameter than said center bore and located between corresponding said upper edge portion and said lower edge portion for attachment to a relatively smaller key ring.

6. The handcuff key of claim 5, said grip or bow defining a rear curved slot having a width and extending along said rear edge between said upper bore and said lower bore and around said center bore and having a width so as to act as a receiver for a key ring, allowing relative motion of said handcuff key for manipulation of said insertion shank, said key remaining on a ring mounted on a belt.

7. The handcuff key of claim 6, said grip or bow defining a front curved slot extending between said upper bore and said lower bore and forward and around said center bore, said front curve slot having a width lesser than said rear curved slot.

8. The handcuff key of claim 3, said opposed first finger grips being concave and arcuate in shape and said opposed second finger grips being concave and arcuate in shape.

9. The handcuff key of claim 1, said shank extension defining a plurality of lightening bores along said centerline thereof.

10. The handcuff key of claim 7, wherein said handcuff key is about 5" in length, said universal shank being about ¾" in length, said shank extension and grip or bow portion being about 4¼" in length and ⅜" in thickness, said shank extension being about 1⅛" in length and said bow or grip being about 2⅛" in diameter.

11. A handcuff key having a grip useful with gloved hands, comprising:

a universal shank having front and rear ends and defining a centerline;

a lock engaging paddle proximate said front end and depending therefrom;

a shank extension and generally circular grip or bow having flat opposed surfaces;

said shank extension being attached to said universal shank rear end and extending rearward therefrom along said centerline;

said grip or bow extending rearward and outward from said shank extension and having a rear edge portion defined at said centerline; and a double-lock stem extending radially from said rear edge portion at a point defined by an angle of about 60 degrees from said centerline at said rear portion of said grip or bow;

wherein a user with a heavily gloved hand may maintain a firm grip on said grip or bow by engaging said first opposed finger holds with adjacent gloved fingers and pressing said rear portion of said grip or bow against the gloved heel of the hand of the user;

whereby the user may easily acquire and maintain a grip on said grip or bow and align and engage the key slot and operate the locking mechanism of a handcuff while wearing a heavy glove, thereby avoiding frostbite resulting from removing the glove in frigid temperatures to operate said universal shank and paddle of said handcuff key.

12. The handcuff key of claim 11, further comprising arcuate, concave first opposed finger holds extending outward from said shank to opposed points defining the forward portion of said grip or bow.

13. The handcuff key of claim 12, said grip or bow defining second arcuate, concave opposed finger grips extending rearward of said opposed points, wherein a user wearing a heavy glove is able to grip said shank extension by a heavily gloved middle, third, and fourth finger, whereby the user, upon reversal of said handcuff key in the gloved hand may easily gain and maintain a grip on said shank extension with heavily gloved middle, third, and fourth fingers, and obtain and maintain an enhanced grip by engaging one of said second finger grips with a heavily gloved first finger, and forcing the other of said second grips in the gloved crotch between the first finger and the thumb of the user, thus allowing the user to guide said rear portion of said grip or bow by gripping said grip or bow between said first finger and the user's gloved thumb, thereby allowing the manipulation of said double-lock stem for insertion into a double-lock stem receiver of a handcuff to double-lock same.

14. The handcuff key of claim 13, said grip or bow having an upper edge portion and a lower edge portion, said upper edge portion and said lower edge portion extending rearward from corresponding said second opposed finger grips.

15. The handcuff key of claim 14, said grip or bow defining a center bore for attachment to a large key ring, and an upper bore and a lower bore, each of lesser diameter than said center bore and located between corresponding said upper edge portion and said lower edge portion for attachment to a relatively smaller key ring, said center bore, said upper bore and said lower bore having centers along a line perpendicular to said centerline.

16. A handcuff key having a grip useful with gloved hands, comprising:

a universal shank having front and rear ends and defining a centerline;

a lock engaging paddle proximate said front end and depending therefrom;

a shank extension and generally circular grip or bow having flat opposed surfaces;

said shank extension being attached to said universal shank rear end and extending rearward therefrom along said centerline;

said grip or bow extending rearward and outward from said shank extension and having a rear edge portion defined at said centerline;

first opposed finger holds extending outward from said shank to opposed points defining the forward portion of said grip or bow;

second opposed finger holds extending inward toward said grip or bow from said opposed points; and a double-lock stem extending radially from said rear edge portion at a point defined by an angle of about 60 degrees from said centerline at said rear portion of said grip or bow;

wherein a user wearing a heavy glove is able to grip said shank extension by a heavily gloved middle, third, and fourth finger; and wherein a user with a heavily gloved hand may maintain a firm grip on said grip or bow by engaging said first opposed finger holds with adjacent gloved fingers and pressing said rear portion of said grip or bow against the gloved heel of the hand of the user;

whereby the user may easily acquire and maintain a grip on said grip or bow and align and engage the key slot and operate the locking mechanism of a handcuff while wearing a heavy glove, thereby avoiding frostbite resulting from removing the glove in frigid temperatures to operate said universal shank and paddle of said handcuff key; and whereby the user, upon reversal of said handcuff key in the gloved hand may easily gain and maintain a grip on said shank extension with heavily gloved middle, third, and fourth fingers, and obtain and maintain an enhanced grip by engaging one of said second finger grips with a heavily gloved first finger, and forcing the other of said second grips in the gloved crotch between the first finger and the thumb of the user, thus allowing the user to guide said rear portion of said grip or bow by gripping said grip or bow between said first finger and the user's gloved thumb, thereby allowing the manipulation of said double-lock stem for insertion into a double-lock stem receiver of a handcuff to double-lock same.

17. The handcuff key of claim 16, said grip or bow having an upper edge portion and a lower edge portion, said upper edge portion and said lower edge portion extending rearward from corresponding said second opposed finger grips, said grip or bow defining a center bore for attachment to a large key ring, and an upper bore and a lower bore, each of lesser diameter than said center bore and located between corresponding said upper edge portion and said lower edge portion for attachment to a relatively smaller key ring, said center bore, said upper bore and said lower bore having centers along a line perpendicular to said centerline.

18. The handcuff key of claim 17, said grip or bow defining a rear curved slot having a width and extending along said rear edge between said upper bore and said lower bore and around said center bore and having a width so as to act as a receiver for a key ring, allowing relative motion of said handcuff key for manipulation of said insertion shank, said key remaining on a ring mounted on a belt.

* * * * *